US005462676A

United States Patent [19]

Pitts

[11] Patent Number: 5,462,676

[45] Date of Patent: Oct. 31, 1995

[54] PROCESS AND SYSTEM FOR TREATING SOLID AND LIQUID WASTE

[75] Inventor: John Pitts, Brockton, Mass.

[73] Assignee: Envirowaste Systems, Inc., Far Hills, N.J.

[21] Appl. No.: 83,629

[22] Filed: Jun. 28, 1993

[51] Int. Cl.[6] ..... B01D 35/18

[52] U.S. Cl. ..... 210/774; 210/770; 210/771; 210/86; 210/769; 210/103; 210/134; 210/175; 210/180; 210/178; 110/342; 110/345; 110/346; 110/186; 48/113; 48/198.7

[58] Field of Search ..... 210/774, 770, 210/103, 769, 771, 772, 86, 134, 175, 178, 180; 110/345, 224, 342, 346, 238, 186; 585/906; 48/113, 198.7

[56] References Cited

U.S. PATENT DOCUMENTS

| | | | |
|---|---|---|---|
| 3,342,731 | 9/1967 | Baumann et al. | 210/774 |
| 3,381,637 | 5/1968 | Farrell, Jr. et al. | 110/186 |
| 3,875,357 | 4/1975 | Foster et al. | 210/774 |
| 4,631,133 | 12/1986 | Axelrod | 210/774 |
| 4,769,157 | 9/1988 | Bässler et al. | 210/774 |
| 5,018,456 | 5/1991 | Williams | 110/342 |
| 5,122,276 | 6/1992 | Loikits | 210/103 |
| 5,224,857 | 7/1993 | Schultz et al. | 432/175 |
| 5,240,593 | 8/1993 | Moredock | 210/90 |
| 5,254,265 | 10/1993 | Chung et al. | 210/774 |

*Primary Examiner*—Ana M. Fortuna
*Attorney, Agent, or Firm*—Lerner, David, Littenberg, Krumholz & Mentlik

[57] ABSTRACT

A system and process for treating solid and liquid wastes, where the solid waste is separated from the liquid waste in a chamber, the liquid waste is passed out of the chamber, the solid waste is converted to ash, a fluid such as liquid waste is introduced into the chamber and combined with the ash, and the ash and fluid are exhausted out of the chamber together. Preferably, the system includes the use of hot air to agitate the solids during their conversion to ash. Desirably, the system also includes a filter and means to swirl the liquid waste as it exits the chamber, so that the liquid waste evenly distributes the solid waste within the filter as the liquid waste is exhausted.

43 Claims, 4 Drawing Sheets

PROCESS AND SYSTEM FOR TREATING SOLID AND LIQUID WASTE

BACKGROUND OF THE INVENTION

Pollution of the world's ground and surface water resources is a topic of national concern. Waste of all levels of toxicity is discharged or migrates into the water supply, presenting serious health risks and a significant drain on communities' financial well-being. One of the greatest threats to the water supply is the lack of proper treatment of residential waste. Residential waste includes all sorts of pollutants, including feces, bacteria, viruses, other microorganisms, soaps, detergents, and food wastes.

Previous inventions have not been able to fulfill the need for an effective yet inexpensive treatment of such waste. Municipal sewer systems are operating at capacity, and are very expensive to expand. On-site conventional septic systems are failure prone and are not very effective in returning clean water to the environment. Further, as population density increases, the space available for on-site septic systems decreases. Some residences simply dump their sewage directly into rivers, streams, lakes and oceans.

On-site systems other than septic systems and cesspools have been proposed. Axelrod, U.S. Pat. No. 4,631,133, discloses a "waste treatment device and method and using microwaves". In that system, solid and liquid waste is introduced into a chamber, where a filter captures the solids and passes the liquids out an outlet. Microwaves and electric coils are used to incinerate the solids. In sales literature accompanying the system, two chambers are disclosed such that one chamber will incinerate the waste while the other chamber collects the waste. The Axelrod system has difficulty in efficiently converting all of the solids to ash as not all of the solids are brought into direct contact with either the coils or microwaves. Further, a separate receptacle is needed to collect the unincinerated solids and ash. Even after the ash is removed, the porous ceramic filter is prone to clogging with small particles and needs to be backflushed in order to clear. Other patents, such as U.S. Pat. Nos. 4,599,954 and 5,018,456 to Williams, disclose using hot air to dry the sludge, but are expensive, inefficient, or ill-suited for residential use.

Therefore, there is a need for an inexpensive and efficient solid and liquid waste treatment system. The present invention provides an arrangement to meet that need.

SUMMARY OF THE INVENTION

The present invention addresses these needs.

One aspect of the present invention provides a process for treating solid and liquid waste in an apparatus. The process includes separating solid waste from liquid waste within the apparatus; passing liquid waste out of the apparatus while retaining solid waste within the apparatus; converting solid waste to ash; introducing additional liquid waste into the apparatus, and; combining the additional liquid waste with the ash and passing the liquid waste and the ash out of the apparatus.

Preferably, the step of converting the solid waste to ash includes heating the solid waste, such as by introducing heated air into the apparatus and agitating the solid waste with the heated air, thus heating substantially all of the solid waste. The heated air is preferably between about 1100° F. to 1250° F., and more specifically, is at a temperature about 1200° F. The heated air enters the apparatus at at least 25 cfm from an aperture of about 1½ inches in diameter. The heating step may also include heating the solid waste by contact with a solid heating element disposed within the apparatus.

Desirably, the process also removes gases from the apparatus during the step of converting the solid waste to ash, purifies the gases by catalytic oxidation, and exhausts the purified gases to atmosphere.

The process preferably includes the step of swirling the fluid as the fluid passes out of the apparatus, such that the fluid agitates the solid waste.

The step of separating may comprise retaining all particles of solid waste greater than 250 microns, and preferably, all particles of solid waste greater than 125 microns.

In another aspect of the present invention, a process for treating solid and liquid waste comprises introducing solid waste and liquid waste into a first apparatus; separating solid waste from liquid waste within the first apparatus; passing the liquid waste out of the first apparatus while retaining the solid waste within the first apparatus; converting the solid waste in the first apparatus to ash; introducing additional liquid waste into the first apparatus; combining the additional liquid waste with the ash and passing the additional liquid waste and the ash out of the first apparatus; introducing further solid waste and further liquid waste into the second apparatus when the first apparatus contains a predetermined amount of solid waste, and; converting the solid waste within the second apparatus into ash when the second apparatus contains a predetermined amount of the further solid waste.

Preferably, the step of converting the solid waste to ash in the first apparatus occurs simultaneously with the step of introducing the solid and liquid waste into the second apparatus. Further, the step of introducing solid waste and liquid waste into the first apparatus occurs simultaneously with the step of converting the solid waste in the second apparatus.

Desirably, the process further comprises sending a first full signal from the first apparatus to a control means, sending a second full signal from the second apparatus to the control means, sending a divert signal from the control means to a diverting means when the control means receives one of the full signals, and causing the diverting means to divert solid and liquid waste to the second apparatus when the control means receives the first full signal and causing the diverting means to divert solid and liquid waste to the first apparatus when the control means receives the second full signal. The first full signal indicates the first apparatus contains a predetermined amount of the solid waste, and, likewise, the second full signal indicates the second apparatus contains a predetermined amount of the solid waste.

In yet another aspect of the present invention, an apparatus for treating solid waste and liquid waste comprises a chamber, an inlet means for introducing solid and liquid waste into the chamber, a separation means for separating the solid waste from the liquid waste, a conversion means for converting the solid waste to ash, and an outlet means for passing the liquid waste out of the apparatus and operative so that liquid waste is combined with the ash and the combined liquid waste and ash is passed out of the apparatus through the outlet means.

The chamber is preferably defined by a lid, a bottom and sides. The inlet means, outlet means, conversion means, and introduction means communicate with the chamber, and the separation means is disposed within the chamber. Yet further, the apparatus includes a solid sensor for detecting the amount of solid waste within the separation means and for providing signals based on the amount of solid waste. The conversion means is selectively operated in response to the signals provided by the solid sensor.

Desirably, the separation means is disposed above the outlet means. Also, the inlet means is disposed above the separation means so that the liquid waste flows into the separation means. High temperature ceramic insulation is disposed in the incineration chamber and adjacent the sides, with a heat shield adjacent the insulation and reflecting radiant heat towards the separation means.

Preferably, the outlet means includes swirling means to swirl the liquid waste as the liquid waste passes out of the chamber. The outlet means is constructed and arranged with the separation means such that the swirling of the liquid waste agitates the solid waste within the separation means. For example, the chamber defines a longitudinal axis and the outlet means radially extends from the longitudinal axis to the sides and connects to the housing at peripheral edges, the peripheral edges being above the center of the outlet means. The outlet means includes a liquid exhaust pipe which communicates with the incineration chamber at the center of the outlet means.

The separation means of the apparatus desirably includes a filter. Yet further, the separation means comprises a removable basket adapted to support the filter. The filter may be removed from and replaced into the basket. Also, the basket and the filter may have closed bottom ends, closed sides, and open top ends which face the inlet means, the conversion means, and the outlet means. The basket may be perforated. Preferably, the filter passes liquids and particle sizes less than 125 microns and retains particle sizes greater than 125 microns. The removable basket is stainless steel.

Desirably, the conversion means includes means for agitating the solid waste within the apparatus while simultaneously heating the solid waste. The conversion means includes a hot air source, a hot air conduit, and a hot air outlet for directing hot air at the solid wastes within the separation means. The hot air outlet directs the hot air in a swirling air flow within the incineration chamber. The conversion means may further comprise a heated electric coil in contact with the solid waste within the separation means. The heated electric coil reaches about 1200° F.

The apparatus may include gas exhaust means for removing gases created during the conversion of the solid waste into the ash. The gas exhaust means may include a means for catalytic oxidation of the gases, and an atmospheric vent for venting the oxidized gases to the atmosphere.

In yet another preferred aspect of the present invention, an apparatus is provided for treating solid waste and liquid waste. The apparatus includes a source of solid and liquid waste and a first and second system, each system comprising a chamber, inlet means for introducing the solid and liquid waste into the chamber, separation means for separating the solid waste from the liquid waste, conversion means for converting the solid waste to ash, and, outlet means for passing the liquid waste out of the apparatus, whereby after the solid waste is converted to the ash, liquid waste is combined with the ash and the combined liquid waste and ash is passed out of the apparatus through the outlet means. The apparatus also includes diverter means connected to the inlet means of the first system, connected to the inlet means of the second system, and connected to the source of the solid and liquid waste. Included further is a control means for providing signals to and receiving signals from the first system, the second system, and the diverter means. The control means instructs the diverter means to supply the solid and liquid waste to the first system when the conversion means of the second system is converting the solid waste to the ash, and instructs the diverter means to supply the solid and liquid waste to the second system when the conversion means of the first system is converting the solid waste to the ash.

Preferably, the source of the solid and liquid waste is a residential dwelling.

In yet a further aspect of the present invention, an apparatus for treating solid waste and liquid waste includes a chamber, an inlet for introducing solid and liquid waste into the chamber, a filter for receiving the solid and liquid waste from the inlet and for retaining the solid waste and passing the liquid waste, and an outlet means disposed below the filter. The outlet means receives the liquid waste passed by the filter, swirls the liquid waste and exhausts the liquid waste out of the apparatus, and is operative with the filter such that the swirling of the passed liquid waste agitates the retained solid waste within the filter.

Preferably, the outlet means has an aperture for exhausting the liquid waste out of the apparatus, and has a cone-shaped dish radially extending from the aperture to the sides and connected to the sides at an edge such that the edge is above the aperture.

DETAILED DESCRIPTION OF THE PREFERRED EMBODIMENT

Figure 1:
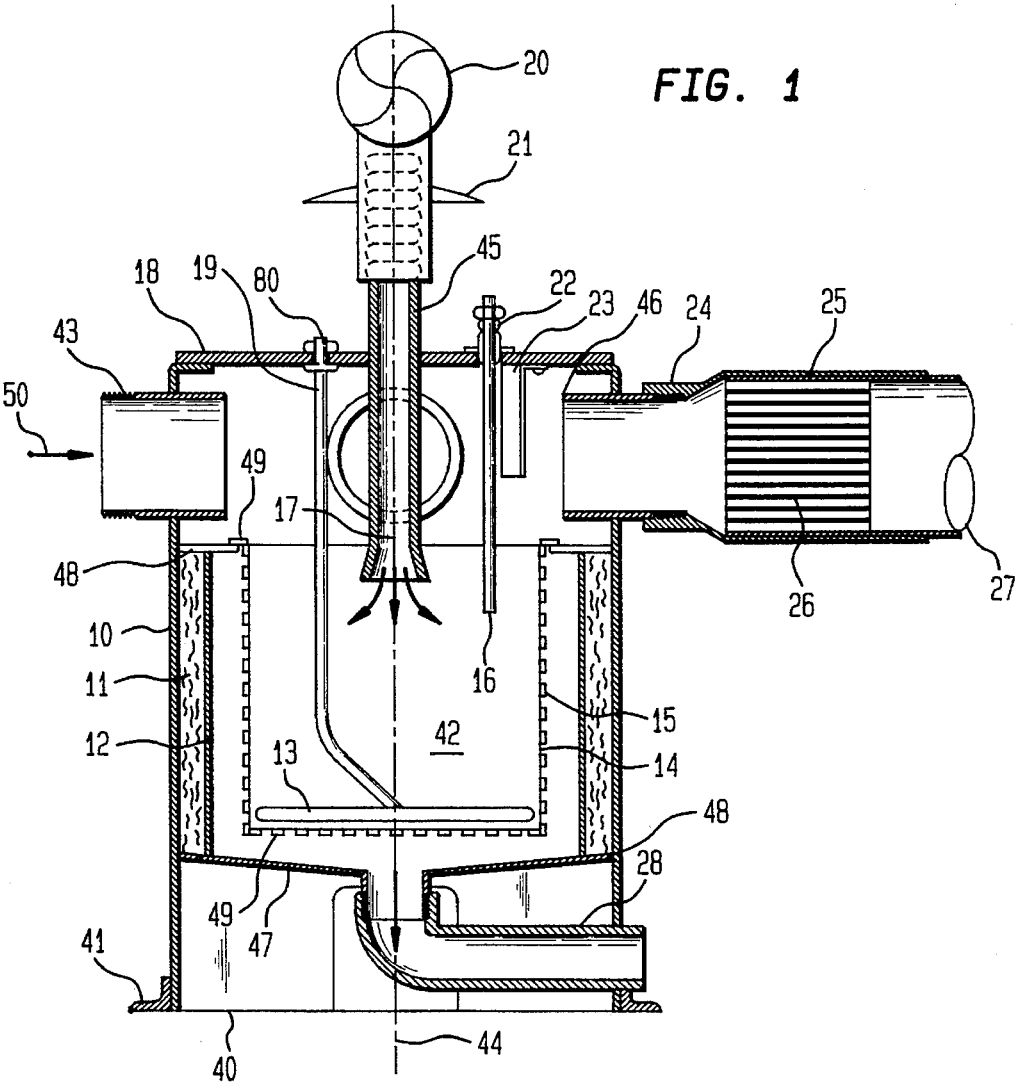
FIG. 1 is a sectional view of a waste treatment system in accordance with one preferred embodiment of the invention.
Figure 2:
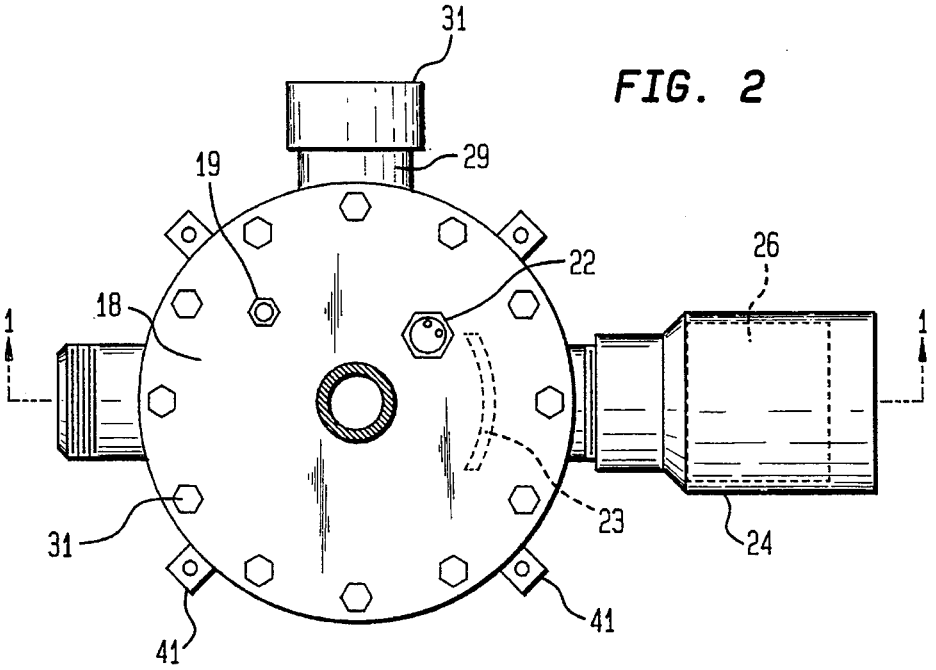
FIG. 2 is a top view of one preferred embodiment of the present invention.

As shown in FIGS. 1 and 2, a system 1 is provided for the treatment of solid and liquid waste in residential and commercial applications. The housing of the system includes cylindrical outer shell 10, lid 18, and bottom 40. Bottom 40 may be open or closed, as shell 10 is preferably mounted to a concrete floor by brackets 41. Preferably, the housing is made of metal, such as stainless steel. While the housing is illustrated having a circular cross section, other shapes are contemplated.

Shell 10 defines a longitudinal axis 44, and for ease of reference directions are stated in this disclosure with reference to the longitudinal axis. Thus the terms "axial" and "axially" should be understood as referring to the directions parallel to the longitudinal axis, whereas the terms "radial" and "radially" should be understood as referring to the directions transverse to this axis. The term "radially inward"

refers to the directions towards the axis, whereas "radially outward" refers to the directions away from the axis. If a first point is referred to as being "above" a second point, then the first point is closer in the axial direction to lid 18 than the second point. Likewise, if a first point is referred to as being "below" a second point, then the first point is closer in the axial direction to bottom 40 than the second point.

Dish 47 is disposed within the volume bounded by shell 10, and dish 47 along with shell 10 and lid 18 defines incineration chamber 42. Dish 47 is above bottom 40, and extends upwardly and radially outwardly from longitudinal axis 44 to the inner surface of shell 10. In other words, dish 47 is cone-shaped and "points" in the direction of ground 40, such that the peripheral edge 48 of dish 47 is higher than the center of the dish. The center of dish 47 defines an aperture which is disposed adjacent and in fluid communication with a mouth of liquid exhaust tube 28. The mouth of liquid exhaust tube 28 communicates with incineration chamber 42 at the center of dish 47, and the end of liquid exhaust tube 28 opposite the mouth is disposed outside of shell 10 and is connected to a station for receiving waste water or "black water" (not shown). This black water station may be either a water purification system immediately adjacent and part of the system, or a leaching pit, town sewer or any other system for treating or receiving liquid waste.

Aside from liquid exhaust tube 28, a number of other elements communicate with incineration chamber 42. For example, one end of inlet tube 43 communicates with and terminates in incineration chamber 42, and the other end of inlet tube 43 is connected to a source of solid and liquid waste material, preferably residential waste. The inlet tube 43 is generally disposed near the top of the incineration chamber 42 by lid 18.

Also communicating with incineration chamber 42 is hot air tube 45. Hot air tube 45 is preferably disposed along longitudinal axis 44, and terminates at a spaced distance below lid 18 within chamber 42. The end of tube 45, also referred to as nozzle 17, flares outwardly such that the cross-sectional area of tube 45 at nozzle 17 is greater than the cross-sectional area of tube 45 immediately adjacent lid 18. Attached to the other end of hot air tube 45 and external to incineration chamber 42 is heat injector 20. Heat injector 20 includes a heating element and a fan for forcing hot air into incineration chamber 42. The source of air used by heat injector 20 is preferably the ambient atmosphere, with the heat injector raising the temperature of the air to between 1100° F. and 1250° F. It is also desired that the hot air injector 20 operate at 1.1 kW, with the hot air leaving nozzle 17 at about 1200° F. Between hot air injector 20 and lid 18 is cone-shaped heat shield 21. Heat shield 21 extends radially outward and downwardly from hot air tube 45 in order to form a shield which will trap and prevent rising heat from interfering with heat injector 20. Preferably if the desired capacity of incineration chamber 42 is about 1½ Gallons, the flow rate of heated air leaving nozzle 17 is 20–25 cfm for a 1½ inch diameter nozzle.

Further communicating with incineration chamber 42 is catalytic oxidizer 25. Catalytic oxidizer 25 communicates with chamber 42 via end 46, which is generally disposed at the top of the chamber and adjacent to lid 18. As seen in FIGS. 1 and 2, end 46 is preferably directly opposite inlet tube 43. Oxidation chamber 26 is connected to end 46, and functions to oxidize any gases which pass into the catalytic converter 25. The oxidized gases leaving chamber 26 are passed to tube 27, which vents the gases to the atmosphere.

Insulation is provided within the incineration chamber 42 in order to promote high heat efficiency. A high temperature-type insulation 11 is annularly disposed along the inner surface of shell 10, and is used to keep heat from escaping incineration chamber 42. Insulation 11 is preferably ceramic, composed of quartz fiber and graded at 2050° F. The insulation axially extends from a point immediately below inlet tube 43 (and catalytic converter tube end 46) to dish 47. The surface of insulation 11 which faces longitudinal axis 44 is coated with a heat shield 12, preferably comprised of stainless steel. The heat shield 12 reflects radiant heat back towards longitudinal axis 44.

Disposed completely within incineration chamber 42 is removable basket 15. The basket 15 is cylindrical and has an open top facing hot air tube 45, inlet tube 43 and catalytic oxidizer end 46. Basket 15 is closed at the bottom by a base 49. The entire basket is perforated. Desirably, the open perforations account for about 46% of the total surface area of the basket. The basket preferably has the same cross-sectional shape as the housing. The basket is suspended within incineration chamber by hanging on ring 48 which extend radially inward from the inner surface of shell 10. The basket 15 includes flange 49 which rests upon ring 48. Preferably, the basket base 49 is a relatively short distance above dish 47.

A fine mesh filter 14 lines the inner surface of basket 15. Thus, filter 14 is substantially the same shape as basket 15, and has an open top and closed bottom. Because the filter is sized to fit within the basket, the filter can be supported within the basket without rigid attachment, such that the filter may be easily removed from and replaced into the basket. While filter 14 will allow liquids and ash to pass therethrough, it will retain solid particles such as solid waste. Although a filter which retains all solid particles larger than 250 mircons produces excellent results, it is preferable to have a very fine filter. It is contemplated that a 125 micron filter is desirable. Preferably, the filter retains all particle sizes greater than about 125 mircons (0.005 inches).

Hanging down from lid 18 and extending to a point above basket base 49 and filter 14 is base heater 13. Base heater 13 extends substantially parallel to longitudinal axis 44 until a short axial distance above basket base 49, when it assumes the shape of a coil immediately adjacent and above basket base 15. Heater 19 is preferably an electrically resistive material such as 80/20 NiChrome, which provides 25 watts per square inch and reaches a temperature of about 1200° F., thusly providing 3.3 kW to the system. A stainless coating on heater 19 protects the electrically resistive material from contacting the waste. In order to provide power to the heater, electricity is supplied to an electric coupling 80 which bridges lid 18 and connects to heating element 19. No heated portion of base heater 19 extends beyond housing 10 or lid 18.

Figure 8:
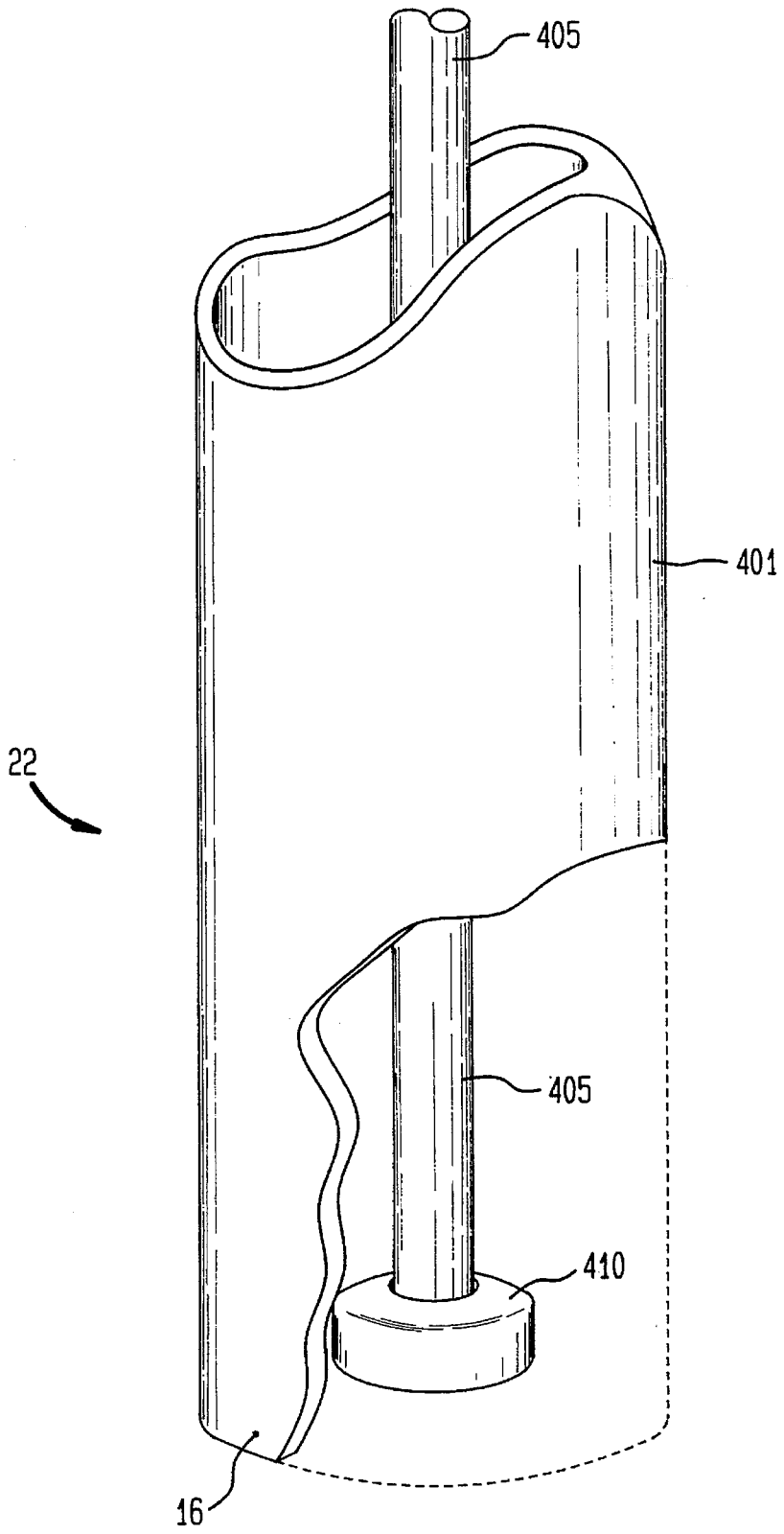
FIG. 8 is a partial sectional view of a solid sensor in accordance with one preferred embodiment of the present invention.

Also extending downwardly from lid 18 is solid sensor 22. As shown in FIG. 8, solid sensor 22 includes hollow sheath 401, rod 405, and float 410. Sheath 401 is fixed to lid 18 and prevents the introduction of solid and liquid waste from disturbing rod 405 or float 410. Rod 405, on the other hand, is not fixed and is capable of axial movement parallel to longitudinal axis 44. The top end of rod 405 is connected to switch 90, which is external to the incineration chamber 42 and on top of lid 18, and the switch 90 detects movement in such axial direction. The bottom end of rod 405 terminates at float 410, made of a buoyant material. The lowest point of float 410 is above the lowest point (end 16) of sheath 401. In other words, both sheath 401 and rod 405 extend downwardly into incineration chamber 42, but protective sheath 401 extends farther down than float 410. The entire solid sensor 22 should be made of materials capable of withstanding the heat and environment of incineration chamber 42. Other types of sensors and other construction of plant sensors may be used.

Also extending downwardly from lid 18 is baffle 23. Baffle 23 blocks any material exiting inlet tube 43 from directly entering catalytic oxidizer 25. Baffle 23 is a spaced distance from catalytic oxidizer end 46, such that gases may freely pass into the catalytic oxidizer.

Preferably, the shell 10 may be 18 inches high from bottom 40 to lid 18, and have a diameter of 12 inches. Pipe 43 may have a diameter of 3 inches, basket 15 may be 8 inches high and 8 inches in diameter, and liquid exhaust tube 28 may be 2 inches in diameter. Preferably, the basket can hold 1½ gallons of solids.

Figure 3:
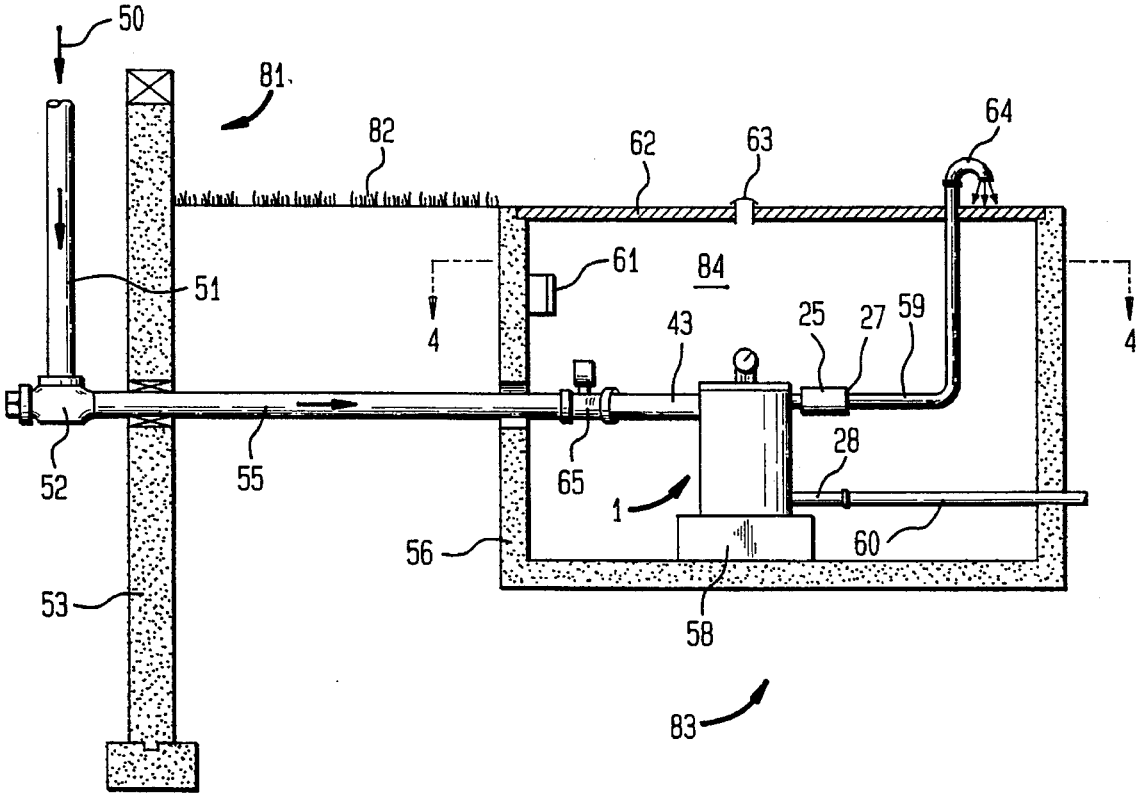
FIG. 3 is a schematic diagram of a waste treatment system in accordance with another preferred embodiment of the present invention.

FIG. 3 is a schematic diagram of the system connected to the plumbing of a residence or business. According to one embodiment, a concrete well 83 is built outside of a home 81, below the surface of lawn 82. Well chamber 84 is defined by concrete walls 56 and lid 62 which prevent natural elements and precipitation from entering well chamber 84.

System 1 is disposed within well chamber 84 and receives waste from building 81. Specifically, a waste drain pipe 51 of the sort typically found in a dwelling is attached to clean out 52, clean out 52 is connected to an underground pipe 55, and underground pipe 55 extends through the foundation wall 53 of dwelling 81, through wall 56 of well 83, and is connected to diverter valve 65.

Figure 4:
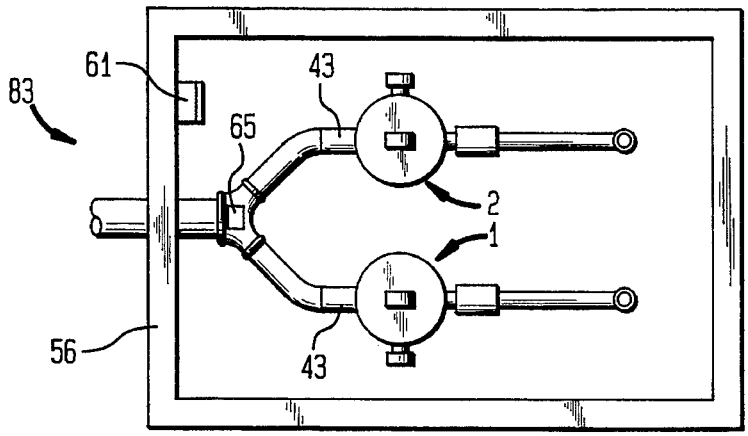
FIG. 4 is a top view of another preferred embodiment of the present invention.

As is apparent from FIG. 4, two identical waste treatment systems 1 and 2 are placed within well 83. The inlet tubes 50 of each system 1 and 2 are connected to diverter valve 65. Diverter valve 65 will direct the waste flow from underground pipe 55 to enter either one of the systems but not both depending upon certain conditions which will be explained more fully below.

For each system, a gases exhaust pipe 59 is connected to exhaust end 27, the exhaust pipe 59 passing through lid 62 and exhausting to the atmosphere via inverted U-shaped pipe 64.

Also for each system, liquid exhaust tube 28 is connected to a pipe 60, which passes through walls 56 of the well 83 and diverts the black water to a sterilization station or other such station as discussed above.

Disposed on a wall 56 of well 83 is a control box 61 which is electrically connected to pass signals to and from diverter valve 65 and the systems 1 and 2. Further, a second control box 54 is disposed within the dwelling 81. The second control box 54 receives and sends signals to and from control box 61.

It is preferable for well lid 62 to include a vent 63 in order to prevent the build up of unwanted gases within the well. The systems 1 and 2 may be placed on a stand 58 in order to raise the systems above any water which might collect within the well.

In operation, residential solid and liquid waste enters pipe 51. The solid waste may include excrement, toilet paper and other such solids, and the liquid waste may include urine, toilet water, bath water, laundry water and the like, although the liquid waste could be any fluid including a pure or cleaning fluid or water if desired. The waste enters pipe 50 and gravitates towards clean out 52. From clean out 52, the waste material passes through underground pipe 55 until it reaches diverter valve 65. For the moment, it will be assumed that diverter valve 65 passes the waste to system 1.

As shown in FIG. 1, waste 50 will pass through inlet tube 43 and into incineration chamber 42. Baffle 23 prevents any of the waste from entering catalytic oxidizer 25, and, therefore, the liquid and solid waste will fall into basket 15. Because of mesh filter 14 and the perforations in basket 15, the liquid materials will pass through the mesh and perforated basket and collect in dish 47, while the solids remain in basket 15. The liquid waste will gravitate towards the center of dish 47, and exit the incineration chamber through the mouth of liquid exhaust tube 28 and through pipe 60 to the liquid purification system (not shown). Because basket base 49 is a relatively short distance above dish 47, the level of the exiting liquid waste will initially be higher than the basket base 49. Further, because of the sloping nature of dish 47, the liquid will tend to swirl as it leaves incineration chamber 42. Therefore, as the liquid swirls out of the chamber, it will tend to agitate and evenly distribute the waste along the bottom and sides of the basket 15. As defined herein, "agitate" shall refer to the dispersion of the solid particles by an agitating medium.

Eventually, the solid waste will accumulate within basket 15 and activate solid sensor 22. The solid sensor will be activated because, as the solid waste accumulates within basket 15, the flow of liquid waste out of basket 15 will be increasingly impeded. Eventually, the liquid waste will enter incineration chamber 42 at a quicker rate than it leaks through basket 15. As the level of liquid waste rises higher than end 16 of sheath 401 of the solid sensor 22, it will contact float 410 and force the float upwards (FIG. 8). Switch 90 will detect the axially upward movement, and send a "full" signal to control box 61. A "full" signal indicates that the solid waste in basket 15 has reached a point where the incineration process should begin. Preferably, the solid sensor will be activated when the solids reach about 1½ gallons based on the unit described herein.

In response to the "full" signal from solid sensor 22, control box 61 (FIGS. 3–4) will switch diverter valve 65 and prevent any more waste from entering system 1. Likewise, diverter valve 65 will also close off inlet 43 to system 1, thus preventing any gases, solids or liquids from exiting system 1 and entering back into underground pipe 55. System 2 will then begin accepting waste and system 1 will begin the incineration process.

In other words, diverter valve 65 will divert the waste into either waste treatment system 1 or waste treatment system 2 depending on which system is best able to accept the waste. By having a dual waste treatment system, one system may accept and accumulate the waste while the other system incinerates. Therefore, there is no interruption in the treatment of waste exiting dwelling 81. Signals passed to control box 61 from systems 1 and 2 notify the control box of which system is currently incinerating and which system is accepting waste, and electrical signals passed from control box 61 to diverter valve 65 inform the diverter valve 65 as to the intended direction of the waste. Diverter valve 65 can be configured with any number of units and so can be used in combination with more than just two systems if desired.

Returning to FIG. 1, the incineration process begins by control box 61 informing the various components of system 1 that the trapped solids should be incinerated. Base heater 19 is provided with electrical energy via electric coupling 80, and begins heating the solids in contact with it. At the same time, heat injector 20 will begin forcing hot air through tube 45 and into incineration chamber 42. The dual heating system will evaporate any liquids within the solids, incinerate the solids, and turn the solids into an extremely fine ash. Further, since hot air injector 20 is introducing air into the system from the atmosphere, the approximately 25% oxygen content of the atmospheric air will fuel the combustion of the materials, and the fuel content of the waste itself will facilitate the incineration.

In addition to heating and evaporating the material, the hot air introduced through tube 45 also extremely agitates the solids, thus bringing more of the solid waste particles in direct contact with the heater 19. This agitation will result in an effective heat transfer. The flare at nozzle 17 of hot air tube 45 ensures a highly dispersive air flow within incineration chamber 45, and will effectively agitate solids in any portion of the basket 15.

As the solids are turned to ash, the vapors and gases leaving the solids will rise up out of basket 15, propelled in part by the air currents created by hot air tube 45. The gases will enter catalytic oxidizer 25 via end 46. When the gases enter oxidation chamber 26, they are purified and deodorized in a manner conventionally known in the art. The odorless and purified exhaust of the converter will pass through end 27 and then enter pipe 59 for venting to the atmosphere via pipe 64. (FIG. 3).

When the incineration process is complete, the heater 19 and hot air injector 20 will turn off. The incineration is considered completed when a predetermined amount of time has expired since the incineration process began. Preferably, in order to incinerate one and one-half gallons of solid waste, the base heater and hot air injector operating at the above described parameters should remain at their preferred operating temperature for about 30–35 minutes. Generally, the incineration of one and one-half gallons (8 lbs.) of waste will leave approximately 2 to 3 tablespoons (4–6 ml) of fine ash in the entire incineration chamber 42. When the system reaches an acceptably cool temperature, system 1 will be ready to begin accepting waste again as soon as system 2 begins its incineration process.

The fine ash will remain in system 1 until additional liquid waste once again begins entering the incineration chamber from input pipe 43. When more waste enters the system, the fine ash will combine with the liquids, and because of the small particle size of the ash, the liquid will carry the fine ash through filter 14 and out liquid exhaust tube 28. Thus, there is no separate exit for the incinerated solid waste.

Therefore, the process of straining solids from liquids, passing out the liquids, incinerating the solids into ash and washing out the ash with the reintroduction of liquids allows the system to operate continuously, without the need to separately remove the build up of any solids. Eventually, it might occur that certain solids will not be reduced to ash and will build up within the basket. This is particularly true for foreign materials such as glass which may be introduced. If so, these solids may be easily removed from the system by opening lid 18 and emptying basket 15 (basket 15 is easily and removably attached to the shell 10 via flange 49 and ring 48). Unlike conventional systems, no piping has to be disturbed in order to remove the build up of non-ash solids. Filter 14 can also be easily serviced or replaced in this manner.

Figure 7:
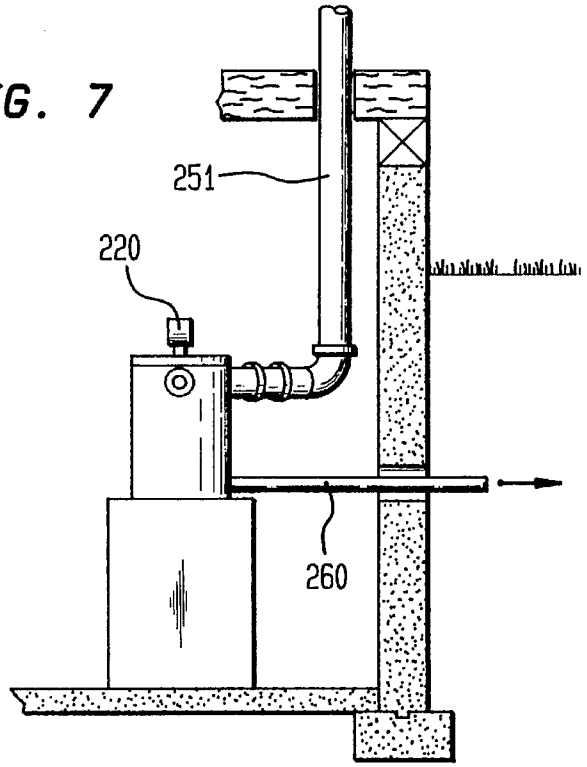
FIG. 7 is a side view of yet another preferred embodiment of the present invention.
Figure 5:
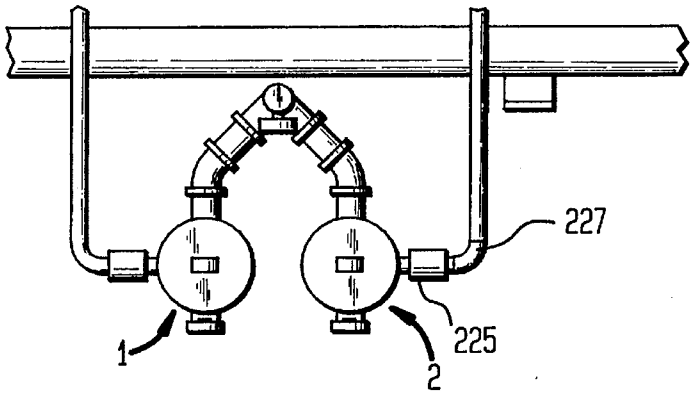
FIG. 5 is a top view of yet another preferred embodiment of the present invention.
Figure 6:
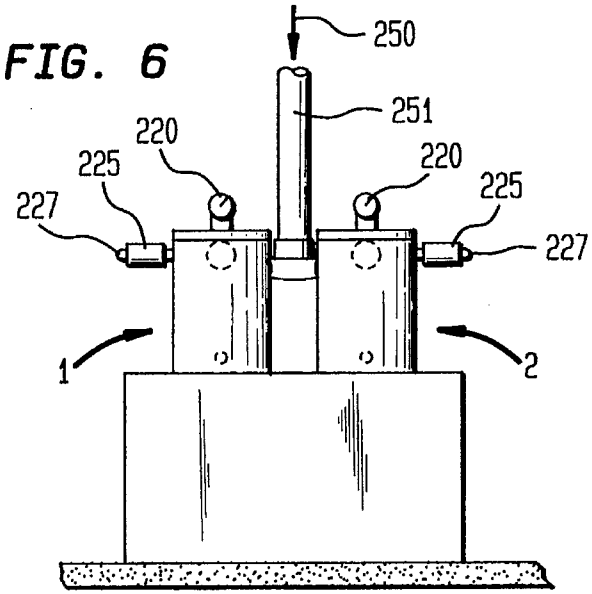
FIG. 6 is a front view of yet another preferred embodiment of the present invention.

While the system is capable of treating the waste of an entire household, it may be made small enough to fit conveniently within the home. Rather than placing the systems 1 and 2 in a well outside the dwelling, the systems may also be placed in a basement, as shown in the alternative preferred embodiment of FIGS. 5–7. Tube 251 would supply the waste, and the black water would exit out liquid exhaust tubes 260. The exhaust from catalytic oxidizer 225 may be vented to the atmosphere. Although small enough to be placed within a dwelling, larger and industrial sizes according to the present invention are certainly possible.

A particular advantage of the system is its ability to be connected directly to the waste lines of a dwelling. Unlike other systems, the present invention is quite efficient in dealing with waste from a variety of sources, including food scraps, bath water, and laundry water in addition to human excrement. Organic materials of any nature are easily incinerated and removed by the passing of liquid waste. Therefore, the system may be used in a variety of applications, including the treatment of agricultural waste.

This system provides excellent advantages when used in conjunction with existing septic tanks. Because the present invention removes solid waste, septic tanks downstream of the system will not clog. The ash is too fine to accumulate in the septic system, and it will decompose rapidly. Further, the system will capture and incinerate nitrates before they reach the septic system. By removing most of the solids, less nutrients will be absorbed by the soil, thus alleviating eutrophication of rivers, streams, and ponds. If desired, a nitrifying bacteria could be added to the system exit line in order to alleviate the ammonia and other such compounds from urine.

The present invention operates with very few mechanically moving parts, and therefore, is resistant to mechanical failure. Pumps and conveyors are not essential to the system since the primary force moving the solid and liquid waste is gravity. In fact, the only mechanically moving part coming in contact with the solid and liquid waste is solid sensor 22. The other mechanically moving unit, heat injector 20, is external to the incineration chamber 42 and will not experience the harsh environment of the incineration chamber.

The agitating air flow within incineration chamber 42 may be controlled by varying the shape of hot air tube nozzle 17. For example, the nozzle could be modified to create a swirling or circular air current within the chamber, which would efficiently agitate the solid waste.

The use of control boxes introduces a great deal of flexibility and control over the systems. Override mechanisms may be manually operated within control box 61 in order to decide which system will accept waste and which system will incinerate waste, depending upon the requirements of the operator. For example, both systems could be selected to simultaneously accept or incinerate, or one or both systems could be shut down. By linking control box 54 in dwelling 81 with control 61, the override mechanisms present in control box 61 could also be operated via control box 54.

Although not shown, the system may include alarms and sensors which update the control boxes 54 and 61. For example, the control boxes could display the status of various aspects of the systems, including which system is currently accepting, which system is currently incinerating, temperatures, and warning signals. If any measured parameter exceeded acceptable levels, the control boxes could take the appropriate action such as shutting both systems down.

Because of the heat created by the system, the heat given off by the system may be recycled into the dwelling, be used to heat a pool, or be used in some similar manner.

As shown in FIG. 2, the system may also include a second page 29 which communicates with chamber 42. This pipe may be alternatively used as a waste inlet or gas exhaust outlet, if it is desirable to do so, i.e., if the system is placed in a corner of the basement. Otherwise, the unused pipe is closed by a cap 31.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. A process for treating solid waste and liquid waste in an apparatus comprising separating said solid waste from said liquid waste within said apparatus, passing said liquid waste out of said apparatus while retaining said solid waste within said apparatus, converting said solid waste to ash within said apparatus, introducing an additional liquid waste into said apparatus, and combining said liquid waste with said ash and passing said additional liquid waste and said ash out of said apparatus.

2. The process of claim 1 wherein said step of converting said solid waste to ash comprises heating said solid waste.

3. The process of claim 2 wherein said step of heating comprises introducing heated air into said apparatus and agitating said solid waste with said heated air such that substantially all of said solid waste is heated.

4. The process of claim 3 wherein said heated air is between about 1100° F. to 1250° F.

5. The process of claim 4 wherein said heated air is at a temperature about 1200° F.

6. The process of claim 5 wherein said heated air enters said apparatus at at least 25 cfm from an aperture of about 1½ inches in diameter.

7. The process of claim 3 further comprising the step of heating said solid waste by contact with a solid heating element disposed within said apparatus.

8. The process of claim 2 further comprising the steps of removing gases from said apparatus during said step of converting said solid waste to ash, purifying said gases by catalytic oxidation, and exhausting said purified gases to atmosphere.

9. The process of claim 2 further comprising the step of swirling said liquid waste as said liquid waste passes out of said apparatus such that said liquid waste agitates said solid waste.

10. The process of claim 9 wherein said step of separating comprises retaining all particles of said solid waste greater than 250 mircons.

11. The process of claim 1 wherein said step of separating comprises retaining all particles of said solid waste greater than 125 mircons.

12. A process for treating solid and liquid waste comprising introducing said solid waste and said liquid waste into a first apparatus, separating said solid waste from said liquid waste within said first apparatus passing said liquid waste out of said first apparatus while retaining said solid waste within said first apparatus, converting said solid waste in said first apparatus to ash, introducing additional liquid waste into said first apparatus, combining said additional liquid waste with said ash and passing said additional liquid waste and said ash out of said first apparatus, diverting solid waste and liquid waste into a second apparatus having the same structure as said first apparatus when said first apparatus contains a predetermined amount of solid waste, separating said liquid waste from said solid, waste and removing said liquid waste from said second apparatus, and converting said further solid waste within said second apparatus into ash when said second apparatus contains a predetermined amount of said solid waste.

13. The process of claim 12 wherein said step of converting said solid waste in said first apparatus to ash occurs simultaneously with said step of introducing said further solid waste and said further liquid waste into said second apparatus.

14. The process of claim 13 further comprising the step of introducing solid waste and liquid waste into said first apparatus occurs simultaneously with said step of converting said further solid waste in said second apparatus.

15. The process of claim 14 further comprising sending a first full signal from said first apparatus to a control means, said first full signal indicating said first apparatus contains a predetermined amount of said solid waste, sending a second full signal from said second apparatus to said control means, said second full signal indicating said second apparatus contains a predetermined amount of said solid waste, and sending a divert signal from said control means to a diverting means when said control means receives one of said full signals, causing said diverting means to divert solid and liquid waste to said second apparatus when said control means receives said first full signal and causing said diverting means to divert solid and liquid waste to said first apparatus when said control means receives said second full signal.

16. An apparatus for treating solid waste and liquid waste comprising, a chamber, inlet means for introducing said solid and liquid waste into said chamber, separating means for separating said solid waste from said liquid waste, conversion means for converting said solid waste to ash in said chamber, said separation means capable of passing ash mixed with liquid waste, and outlet means connected to said chamber for passing out said liquid waste and said ash from said chamber.

17. The apparatus of claim 16 wherein said chamber is defined by a lid, a bottom, and sides, and wherein said inlet means, said outlet means, said conversion means communicate with said chamber, and said separation means is disposed within said chamber.

18. The apparatus of claim 17 further comprising a solid sensor for detecting the amount of solid waste within said separation means and for providing signals based on said amount of solid waste, said conversion means being selectively operated in response to said signals provided by said solid sensor.

19. The apparatus of claim 17 wherein said separation means is disposed above said outlet means.

20. The apparatus of claim 19 wherein said inlet means is disposed above said separation means so that said liquid waste flows into said separation means.

21. The apparatus of claim 20 further comprising high temperature ceramic insulation disposed in said chamber and adjacent said sides and a heat shield adjacent said insulation and for reflecting radiant heat towards said separation means.

22. The apparatus of claim 21 wherein said outlet means includes swirling means to swirl said liquid waste as said liquid waste passes out of said chamber, and said outlet means is constructed and arranged with said separation means such that the swirling of said liquid waste agitates said solid waste within said separation means.

23. The apparatus of claim 22 wherein said chamber defines a longitudinal axis and said outlet means radially extends from said longitudinal axis to said sides and connects to said housing at peripheral edges, said peripheral edges being above the center of said outlet means, said outlet means including a liquid exhaust pipe which communicates with said incineration chamber at said center of said outlet means.

24. The apparatus of claim 23 wherein said separation means includes a filter.

25. The apparatus of claim 24 wherein said separation means further comprises a removable basket adapted to support said filter.

26. The apparatus of claim 25 wherein said filter is removably and replaceably associated with said basket.

27. The apparatus of claim 26 wherein said basket and said filter have closed bottom ends, closed sides, and open top ends which face said inlet means, said conversion means, and said outlet means.

28. The apparatus of claim 27 wherein said basket is perforated.

29. The apparatus of claim 28 wherein said filter passes liquids and particle sizes less than 125 microns and retains particle sizes greater than 125 microns.

30. The apparatus of claim 29 wherein said removable basket is stainless steel.

31. The apparatus of claim 16 wherein said conversion means includes means for agitating said solid waste within said apparatus while simultaneously heating the solid waste.

32. The apparatus of claim 31 wherein said conversion means includes a hot air source, a hot air conduit, and a hot air outlet for directing hot air at said solid wastes within said separation means.

33. The apparatus of claim 32 wherein said hot air outlet directs said hot air in a swirling air flow within said conversion chamber.

34. The apparatus of claim 33 wherein said conversion means further comprises a heated electric coil in contact with said solid waste within said separation means.

35. The apparatus of claim 34 wherein said heated electric coil reaches about 1200° F.

36. The apparatus of claim 31 further comprising gas exhaust means for removing gases created during the conversion of said solid waste into said ash.

37. The apparatus of claim 36 wherein said gas exhaust means comprises a means for catalytic oxidation of said gases, and an atmospheric vent for venting the oxidized gases to the atmosphere.

38. An apparatus for treating solid waste and liquid waste comprising:

a source of said solid and liquid waste, a first and second systems each system comprising a chamber, inlet means for introducing said solid and liquid waste into said chamber, separation means for separating said solid waste from said liquid waste, conversion means for converting said solid waste to ash in said chamber, the separation means being capable of separating a mixture of ash and liquid waste from said solid waste, outlet means for passing out liquid waste and ash from said chamber, diverter means connected to said inlet means of said first system, to said inlet means of said second system, and to said source of said solid and liquid waste, a control means for providing signals to and receiving signals from said first system, said second system and said diverter means, wherein said control means instructs said diverter means to supply said solid and liquid waste to said first system when said conversion means of said second system is converting said solid waste to ash, and instructs said diverter means to supply said solid and liquid waste to said second system when said conversion means of said firs system is converting said solid waste to ash.

39. The apparatus of claim 38 wherein said source of said solid and liquid waste is a residential dwelling.

40. An apparatus for treating solid waste and liquid waste comprising a chamber, an inlet for introducing said solid and liquid waste into said chamber, a filter for receiving said solid and liquid waste from said inlet and for retaining said solid waste and removing said liquid waste, an outlet means disposed below said filter for receiving the removed liquid waste, swirling said liquid waste and exhausting said liquid waste out of said apparatus, said outlet means operative with said filter such that the swirling of said passed liquid agitates the retained solid waste within said filter.

41. The apparatus of claim 40 wherein said outlet means comprises an aperture for exhausting said liquid waste out of said apparatus and a cone-shaped dish radially extending from said aperture to said sides and connected to said sides at an edge such that said edge is above said aperture.

42. A process for treating waste, including both solid and liquid waste, in an apparatus comprising separating said solid waste from said liquid waste within said apparatus, passing said liquid waste out of said apparatus while retaining said solid waste within said apparatus, heating said solid waste to ash within said apparatus, introducing an additional liquid waste into said apparatus, combining said liquid waste with said ash and passing said additional liquid waste and said ash out of said apparatus, and removing gases from said apparatus during said step of heating, purifying said gases by catalytic oxidation, and exhausting said purified gases to atmosphere.

43. An apparatus for treating solid waste and liquid waste comprising a chamber, inlet means for introducing said solid and liquid waste into said chamber, separation means for separating said solid waste from said liquid waste, conversion means for converting said solid waste to ash, and outlet means operative so that said liquid waste is combined with said ash and the combined liquid waste and ash is passed out of said apparatus through said outlet means, said outlet means including swirling means to swirl said liquid waste as said liquid waste passes out of said chamber, said outlet means constructed and arranged with said separation means such that the swirling of said liquid waste agitates said solid waste within said separation means.

* * * * *

UNITED STATES PATENT AND TRADEMARK OFFICE

CERTIFICATE OF CORRECTION

PATENT NO. : 5,462,676

DATED : October 31, 1995

INVENTOR(S) : Pitts

It is certified that error appears in the above-identified patent and that said Letters Patent is hereby corrected as shown below:

Column 11, line 31, "temperature about" should read --temperature of about--

Column 12, line 5, "solid, waste" should read --solid waste--

Column 13, line 63, "a first and second" should read --first and second--

Column 14, line 17, "firs system" should read --first system--

Signed and Sealed this

Second Day of April, 1996

Bruce Lehman

*Attest:*

BRUCE LEHMAN

*Attesting Officer*

*Commissioner of Patents and Trademarks*